US007200873B2

(12) United States Patent
Klotz et al.

(10) Patent No.: US 7,200,873 B2
(45) Date of Patent: Apr. 10, 2007

(54) HEAD GEAR APPARATUS HAVING IMPROVED AIR FLOW ARRANGEMENT

(75) Inventors: Conrad Klotz, Nappanee, IN (US); Chris Clupper, Columbia City, IN (US); Rudy R. Diaz, Goshen, IN (US); Kimberly A. Dwyer, Fort Wayne, IN (US); Sam Sackett, Fort Wayne, IN (US); Trent Wilkinson, Larwill, IN (US)

(73) Assignee: DePuy Products, Inc., Warsaw, IN (US)

( * ) Notice: Subject to any disclaimer, the term of this patent is extended or adjusted under 35 U.S.C. 154(b) by 0 days.

(21) Appl. No.: 11/322,433

(22) Filed: Dec. 29, 2005

(65) Prior Publication Data

US 2006/0101557 A1 May 18, 2006

Related U.S. Application Data

(63) Continuation of application No. 10/622,527, filed on Jul. 18, 2003, now Pat. No. 6,990,691.

(51) Int. Cl.
*A42C 5/04* (2006.01)

(52) U.S. Cl. ..... 2/171.3; 128/201.24

(58) Field of Classification Search ..... 2/410, 2/171.3, 424, 436, 437, 171.4, DIG. 1; 128/201.24, 128/201.25

See application file for complete search history.

(56) References Cited

U.S. PATENT DOCUMENTS 195,865 A 10/1877 Wilson
1,037,206 A 9/1912 Clifford
1,445,176 A 2/1923 Schmelzer
1,467,227 A 9/1923 Capell
1,715,071 A 5/1929 Martens et al.
1,766,272 A 6/1930 Vallier
1,818,607 A 8/1931 Campbell
1,825,114 A 9/1931 Hendrickson
1,867,809 A 7/1932 Chase (Continued)

FOREIGN PATENT DOCUMENTS

DE 26 00 486 7/1976

(Continued)

*Primary Examiner*—Rodney Lindsey
(74) *Attorney, Agent, or Firm*—Maginot, Moore & Beck

(57) ABSTRACT

A surgical garment includes a head gear apparatus for supporting a face shield and shroud. The head gear apparatus includes a helmet that supports a fan assembly, and that defines forward and rear ventilation passageways. The helmet includes a chin bar that defines a centrally located slot, and an upper ledge. The upper edge of the face shield contacts the upper ledge, while the lower edge of the shield includes a tab that extends through the slot. The chin bar and face shield include a plurality of magnetic elements that magnetically connect the lower edge of the face shield to the chin bar. The helmet is suspended from a strap assembly that is carried directly on the head of the wearer. The strap assembly includes an adjustable occipital support that bears against the occiput of the wearer. The face shield can include a plurality of film layers that can be removed when soiled. The fan assembly includes an inlet opening and the shroud includes a filter assembly that is sized to overlay the inlet opening and a portion of the helmet surrounding the inlet opening.

7 Claims, 9 Drawing Sheets

U.S. PATENT DOCUMENTS

| | | | | |
|---|---|---|---|---|
| 2,011,298 | A | | 8/1935 | Osbun et al. |
| 2,350,939 | A | | 6/1944 | Sprouse |
| 2,361,676 | A | | 10/1944 | Baker |
| 2,660,401 | A | | 11/1953 | Hull, Jr. |
| 2,772,538 | A | | 12/1956 | Ullery |
| 2,814,043 | A | | 11/1957 | Alesi |
| 3,018,776 | A | | 1/1962 | Saitta |
| 3,025,525 | A | | 3/1962 | Larson |
| 3,048,776 | A | | 8/1962 | Logan |
| 3,058,463 | A | | 10/1962 | Goodrich, Jr. |
| 3,103,014 | A | | 9/1963 | Morgan |
| 3,140,042 | A | | 7/1964 | Fuji |
| 3,156,922 | A | | 11/1964 | Anderson |
| 3,168,748 | A | | 2/1965 | Limberg |
| 3,214,809 | A | | 11/1965 | Edwards |
| 3,314,077 | A | | 4/1967 | Marchello |
| 3,354,468 | A | | 11/1967 | Bowers, Jr. |
| 3,368,744 | A | | 2/1968 | Jenn |
| 3,444,817 | A | | 5/1969 | Caldwell |
| 3,491,374 | A | | 1/1970 | Frangos |
| 3,529,594 | A | | 9/1970 | Charnley |
| 3,549,831 | A | | 12/1970 | Forney |
| 3,803,640 | A | | 4/1974 | Ericson |
| 3,822,698 | A | | 7/1974 | Guy |
| 3,881,198 | A | | 5/1975 | Waters |
| 3,955,570 | A | | 5/1976 | Hutter, III |
| 3,963,021 | A | | 6/1976 | Bancroft |
| 4,019,508 | A | | 4/1977 | Der Estephanian et al. |
| 4,038,979 | A | | 8/1977 | McCosker |
| 4,055,123 | A | | 10/1977 | Heidelberg |
| 4,055,173 | A | | 10/1977 | Knab |
| 4,115,874 | A | * | 9/1978 | Hasegawa ..... 2/425 |
| 4,121,115 | A | | 10/1978 | de Méré |
| 4,133,308 | A | | 1/1979 | Lowe et al. |
| 4,136,688 | A | | 1/1979 | Gorman |
| 4,174,924 | A | | 11/1979 | Smithson, Jr. |
| 4,227,520 | A | | 10/1980 | Lord |
| 4,263,679 | A | | 4/1981 | Erlendson |
| 4,280,491 | A | | 7/1981 | Berg et al. |
| 4,290,150 | A | * | 9/1981 | Guerre-Berthelot ..... 2/421 |
| 4,296,746 | A | | 10/1981 | Mason, Jr. et al. |
| 4,336,799 | A | | 6/1982 | Almasi et al. |
| 4,364,712 | A | | 12/1982 | Charles |
| 4,455,687 | A | | 6/1984 | Johansson |
| 4,462,119 | A | | 7/1984 | Rudd |
| 4,462,399 | A | | 7/1984 | Braun |
| 4,469,097 | A | | 9/1984 | Kelman |
| 4,531,890 | A | | 7/1985 | Stokes |
| 4,549,103 | A | | 10/1985 | Shiga |
| 4,549,541 | A | | 10/1985 | Sundahl |
| 4,549,542 | A | * | 10/1985 | Chien ..... 128/201.24 |
| 4,589,408 | A | | 5/1986 | Singer |
| 4,590,951 | A | | 5/1986 | O'Connor |
| 4,619,254 | A | | 10/1986 | Moretti et al. |
| 4,651,727 | A | | 3/1987 | Howorth |
| 4,664,593 | A | | 5/1987 | Hayashi et al. |
| 4,667,667 | A | | 5/1987 | Schnoor et al. |
| 4,672,968 | A | | 6/1987 | Lenox et al. |
| 4,674,492 | A | | 6/1987 | Niemeyer |
| 4,676,236 | A | | 6/1987 | Piorkowski et al. |
| 4,711,033 | A | | 12/1987 | Mitchell |
| 4,711,539 | A | | 12/1987 | Krusas et al. |
| 4,730,612 | A | | 3/1988 | Dampney |
| 4,744,106 | A | | 5/1988 | Wang |
| 4,752,974 | A | | 6/1988 | Haino |
| 4,771,226 | A | | 9/1988 | Jones |
| D298,473 | S | | 11/1988 | Stackhouse et al. |
| 4,810,269 | A | | 3/1989 | Stackhouse et al. |
| 4,826,513 | A | | 5/1989 | Stackhouse et al. |
| D303,166 | S | | 8/1989 | Stackhouse et al. |
| 4,864,654 | A | | 9/1989 | Schriver et al. |
| 4,875,477 | A | | 10/1989 | Waschke et al. |
| D304,612 | S | | 11/1989 | Stackhouse et al. |
| D304,854 | S | | 11/1989 | Stackhouse et al. |
| D306,363 | S | | 2/1990 | Stackhouse et al. |
| 4,901,716 | A | | 2/1990 | Stackhouse et al. |
| 4,915,588 | A | | 4/1990 | Brackett |
| 4,951,662 | A | | 8/1990 | Townsend, Jr. |
| 4,986,282 | A | | 1/1991 | Stackhouse et al. |
| 4,995,117 | A | * | 2/1991 | Mirage ..... 2/410 |
| 4,999,846 | A | | 3/1991 | Ball et al. |
| 5,003,973 | A | | 4/1991 | Ford et al. |
| 5,009,225 | A | | 4/1991 | Vrabel |
| 5,029,342 | A | | 7/1991 | Stein et al. |
| 5,042,474 | A | | 8/1991 | Williamson |
| 5,046,492 | A | | 9/1991 | Stackhouse et al. |
| 5,048,516 | A | | 9/1991 | Söderberg |
| 5,051,881 | A | | 9/1991 | Herold |
| 5,054,479 | A | | 10/1991 | Yelland et al. |
| 5,054,480 | A | | 10/1991 | Bare et al. |
| 5,069,205 | A | | 12/1991 | Urso |
| 5,085,231 | A | | 2/1992 | Johnson |
| 5,088,117 | A | | 2/1992 | Fulmer |
| H001023 | H | | 3/1992 | Wiseman, Sr. |
| 5,104,430 | A | | 4/1992 | Her-Mou |
| 5,125,402 | A | | 6/1992 | Greenough |
| 5,140,980 | A | | 8/1992 | Haughey et al. |
| 5,142,704 | A | | 9/1992 | Viemeister et al. |
| 5,142,706 | A | | 9/1992 | Layhon |
| 5,193,347 | A | | 3/1993 | Apisdorf |
| 5,226,939 | A | | 7/1993 | Nicolas et al. |
| 5,237,707 | A | | 8/1993 | Lowrie |
| 5,251,334 | A | | 10/1993 | Yang |
| 5,253,642 | A | | 10/1993 | Stackhouse et al. |
| 5,283,914 | A | | 2/1994 | James |
| 5,313,665 | A | | 5/1994 | Luczenbacher, Sr. et al. |
| 5,342,121 | A | | 8/1994 | Koria |
| 5,349,949 | A | | 9/1994 | Schegerin |
| 5,354,178 | A | | 10/1994 | Ferleger et al. |
| 5,373,588 | A | | 12/1994 | Hede et al. |
| 5,380,245 | A | | 1/1995 | Reiterman et al. |
| 5,394,566 | A | | 3/1995 | Hong |
| 5,410,757 | A | | 5/1995 | Vienamo et al. |
| 5,452,712 | A | | 9/1995 | Richardson |
| 5,456,248 | A | | 10/1995 | Holian et al. |
| 5,492,116 | A | | 2/1996 | Scarberry et al. |
| 5,503,146 | A | | 4/1996 | Froehlich et al. |
| 5,515,843 | A | | 5/1996 | Chang |
| 5,520,668 | A | | 5/1996 | Greff et al. |
| 5,525,278 | A | | 6/1996 | Krosch et al. |
| 5,533,500 | A | | 7/1996 | Her-Mou |
| 5,549,104 | A | | 8/1996 | Crump et al. |
| 5,553,500 | A | | 9/1996 | Grahn et al. |
| 5,564,124 | A | | 10/1996 | Elsherif et al. |
| 5,577,495 | A | | 11/1996 | Murphy |
| 5,578,000 | A | | 11/1996 | Greff et al. |
| 5,588,153 | A | | 12/1996 | Ignon et al. |
| 5,592,030 | A | | 1/1997 | Adahan |
| 5,592,936 | A | | 1/1997 | Thomas, Jr. et al. |
| 5,601,078 | A | | 2/1997 | Schaller et al. |
| 5,620,441 | A | | 4/1997 | Greff et al. |
| 5,624,234 | A | | 4/1997 | Neely et al. |
| 5,655,374 | A | | 8/1997 | Santilli et al. |
| 5,664,566 | A | | 9/1997 | McDonald et al. |
| 5,669,375 | A | | 9/1997 | Dahrendorf et al. |
| 5,682,618 | A | | 11/1997 | Johnson et al. |
| 5,687,713 | A | | 11/1997 | Bahr et al. |
| 5,690,095 | A | | 11/1997 | Glynn et al. |
| 5,711,033 | A | | 1/1998 | Green et al. |
| 5,720,281 | A | | 2/1998 | Allen et al. |
| 5,804,894 | A | | 9/1998 | Leeson et al. |
| 5,835,366 | A | | 11/1998 | Pleso et al. |
| 5,879,493 | A | | 3/1999 | Johnson et al. |
| 5,887,281 | A | | 3/1999 | Green et al. |

| | | | | |
|---|---|---|---|---|
| 5,961,289 | A | 10/1999 | Lohmann | |
| 5,964,576 | A | 10/1999 | Fujita et al. | |
| 5,984,638 | A | 11/1999 | Gresh et al. | |
| 6,014,971 | A | 1/2000 | Danisch et al. | |
| 6,047,411 | A | 4/2000 | Ryden et al. | |
| 6,081,929 | A | 7/2000 | Rothrock et al. | |
| 6,122,773 | A | 9/2000 | Katz | |
| 6,170,090 | B1 * | 1/2001 | Minor | 2/411 |
| 6,263,513 | B1 * | 7/2001 | Murakami | 2/171.3 |
| 6,374,823 | B1 | 4/2002 | Hafianpour | |
| 6,393,617 | B1 | 5/2002 | Paris et al. | |
| 6,481,019 | B2 | 11/2002 | Diaz et al. | |
| 6,536,045 | B1 | 3/2003 | Wilson et al. | |
| 6,691,702 | B2 * | 2/2004 | Appel et al. | 128/202.26 |
| 6,792,944 | B1 | 9/2004 | Green et al. | |
| 6,796,304 | B2 | 9/2004 | Odell et al. | |
| 6,847,492 | B2 | 1/2005 | Wilson et al. | |
| 2001/0032348 | A1 | 10/2001 | Diaz et al. | |

FOREIGN PATENT DOCUMENTS

| | | |
|---|---|---|
| DE | 3229430 A1 * | 3/1983 |
| DE | 27 44 488 | 4/1983 |
| FR | 1017797 | 12/1952 |
| GB | 2 183 488 | 6/1987 |
| SU | 986429 | 1/1983 |
| SU | 1068130 | 1/1984 |
| WO | WO 88/09193 | 12/1988 |
| WO | WO 91/18569 | 12/1991 |
| WO | WO 94/03235 | 2/1994 |

* cited by examiner

HEAD GEAR APPARATUS HAVING IMPROVED AIR FLOW ARRANGEMENT

This application is a continuation of co-pending application Serial No. 10/622,527, filed on Jul. 18, 2003, now U.S. Pat. No. 6,990,691 the disclosure of which is hereby totally incorporated by reference in its entirety.

BACKGROUND OF THE INVENTION

The present invention is directed to a head gear apparatus that incorporates a face shield and apparatus that incorporates a ventilation system. The present invention has particular application for use with a garment worn by a medical caregiver during surgical procedures.

In many surgical procedures, medical personnel wear garments that are intended to maintain a barrier between the personnel and the patient. This barrier helps maintain sterile conditions in the operating room setting by completely shrouding the medical personnel and their clothing. In addition, this barrier serves to protect the caregiver from exposure to blood and body fluids. Various organizations, such as OSHA, promulgate recommendations regarding occupational exposure to fluid-borne pathogens during medical procedures. The surgical gown or shroud helps meet these recommendations.

One such surgical gown, or personal protection system, is the PROVISION.™. System, marketed by DePuy Orthopaedics Co., Inc. This system includes a helmet system that integrates with a barrier hood and gown. The hood and gown are composed of a HYTREL.RTM. elastomer (provided by DuPont deNemours) that allows heat to escape while maintaining a fluid-impervious barrier protection. In addition to the gown material, a face shield or bubble is provided to allow the caregiver a protected view of the surgical arena.

The helmet system supports at least the barrier hood. Since the medical caregiver is essentially encased within the hood and gown, ventilation is of critical importance. Ventilation is necessary for air supply, CO.sub.2 discharge, heat control and anti-fogging of the face shield. Thus, the helmet component of the PROVISION.™. System includes an air moving and filtration system. The system draws ambient air through a filter assembly and directs the filtered air through vents formed in the helmet. In the PROVISION.™. System, air is directed across the face of the wearer and across the face shield. The air mover is an electric fan that connects to an external power supply and speed control worn about the waist of the caregiver.

Certain aspects of the PROVISION.™. System are described in U.S. Pat. No. 6,393,617, assigned to the owner of the present invention. The specification and figures of this application are incorporated herein by reference. For purposes of illustration, certain features of the helmet system described in the '617 patent are shown in FIG. 1. The surgical garment 10 includes a face shield 12 attached to a fabric shroud 14. A helmet 16 includes an interior pad 27 to improve comfort. The helmet supports a fan assembly 18 that can be adjusted fore and aft along the helmet for the comfort of the wearer. The shroud 14 incorporates a filter element 20 that is situated directly above the inlet to the fan assembly 18 when the shroud is positioned over the helmet. The filter element 20 is configured to grip the perimeter of a flange 21 formed on the fan assembly so that the filter is sealed over the fan inlet.

The ventilation aspect of the surgical garment 10 is accomplished through a ventilation duct 22 formed within the helmet 16. The duct 22 is arranged to direct air flow from the fan assembly 18 to the front of the helmet, and more particularly across the face shield 12 and the face of the wearer. An adjustable airflow deflector 23 is positioned within the duct 22 to control the direction of air flow passing across the face shield. For instance, the deflector can be extended to its position 23' to direct most of the air flow across the face of the caregiver wearing the garment 10. This adjustment can be readily accomplished by grasping the control knob through the shroud 14.

The helmet 16 is stabilized by an adjustable strap assembly 24 that is pivotably attached to the helmet. The assembly includes a forehead strap portion 25 that engages the forehead of the wearer. The forehead strap portion includes a pad for the comfort of the wearer. The strap assembly 24 also includes an adjustable nape strap portion 26 that is arranged to grip the nape of the neck of the caregiver. The nape strap portion includes two straps that are coupled through an adjustment mechanism 28. Rotating the knob on the adjustment mechanism 28 draws the two straps of the nape strap portion 26 together to tighten the strap assembly 24 onto the head of the wearer.

The aforementioned PROVISION.™. System incorporates many features of the garment system shown in FIG. 1. In addition, the PROVISION.™. System incorporates a chin bar that extends from the forward portion of the helmet underneath the chin of the wearer. The chin bar helps support the lower edge of the face shield 12, especially when the caregiver moves or bends over. In another feature of the PROVISION.™. System, attachment strips are provided across the front of the helmet and the central portion of the chin bar. The shroud 14 is provided with mating attachment strips so that the shroud can be removably attached to the helmet assembly. This attachment helps maintain the shroud and face shield in position even when the wearer is moving. These attachment strips incorporate hook and loop type fasteners so that the shroud can be detached and reattached as necessary.

The surgical garment 10 shown in FIG. 1 and the PROVISION.™. System provide significant advantages in comfort and ease of use over prior ventilated garments. The helmet and strap arrangements solidly support the fan assembly on the head of the caregiver, and the adjustable position of the fan assembly helps achieve a well-balanced helmet arrangement. The ventilation duct 22 directs air flow at the critical path across the face shield 12 and the face of the wearer. While this system presents a significant improvement over prior systems, there is a continuing motivation to enhance the comfort, ease of use and versatility of ventilated surgical garments.

SUMMARY OF THE INVENTION

In view of this continuing motivation, the present invention contemplates improvements to a ventilated surgical garment that increase the comfort of wearing the garment, enhance the ventilation characteristics, and improve the ease of donning the garment.

In one embodiment of the invention, a head gear apparatus comprises a helmet configured to be supported on the head of a wearer, with at least two airflow passageways defined by the helmet. A first one of the passageways is arranged to direct airflow across the back of the wearer and a second one of the passageways is arranged to direct airflow across the face of the wearer when the helmet is supported on the head of the wearer. The head gear apparatus includes a fan supported by the helmet to direct airflow through the two airflow passageways.

In one feature of this embodiment, at least one of the airflow passageways includes means for adjusting the airflow through the passageway. In a preferred embodiment, both the forward and rear passageways include means for adjusting the airflow through the corresponding passageway. The second or rear airflow passageway can includes a plurality of portals defined in the helmet adjacent the fan. The portals are arranged to direct airflow across the back of the wearer. In a most preferred embodiment, each portal includes a baffle that is arranged to specifically direct the airflow to the neck of the wearer.

The means for adjusting the airflow through the rear airflow passageway can include a louver plate disposed within the helmet between the plurality of portals and the fan. The louver plate defines a plurality of louver openings corresponding to the plurality of portals, with walls between the portals. The louver plate is slidable within the helmet to adjustably overlap at least a portion of the portals. The louver plate can preferably move from a first position in which the louver openings are aligned with the portals to permit full airflow through the portals, to a second position in which the walls completely overlap the portals, thereby effectively stopping airflow through the portals across the wearer's back.

In another embodiment of the invention, a head gear apparatus comprises a helmet configured to be supported on the head of a wearer, a number of airflow passageways defined by the helmet to direct airflow across the body of the wearer and a fan supported by the helmet to direct airflow through the number of airflow passageways. In this embodiment, a strap assembly is provided for supporting the helmet without allowing the helmet to contact the head of the wearer. The strap assembly can include a head band configured to be supported on the head of the wearer and a strap arrangement connected between the head band and the helmet to support the helmet so that the helmet is not supported directly on the head of the wearer.

In certain embodiments, this strap arrangement includes a crown strap that extends along at least the side of the wearer's head, and an attachment tab extending from the crown strap. The attachment tab is connected to the helmet. In a preferred embodiment, a pair of crown straps are provided that extend along opposite sides of the wearer's head and that are sized to meet at the crown of the wearer's head. A fastener disposed between the pair of crown straps can adjustably fasten the straps together at the top of the wearer's head.

In the preferred embodiment, each crown strap defines a cut-out with a corresponding attachment tab positioned within the cut-out. Preferably, a top portion of the attachment tab is integral with the crown strap and an opposite bottom portion of the attachment tab is connected to the helmet. The attachment tab and cut-out resiliently suspends the helmet from the strap assembly so that tightening of the head band does not exert any force on the connection between the helmet and tabs.

In a further feature of the invention, the strap assembly includes an occipital support connected to the head band. The occipital support is configured to bear against the occiput of the wearer when the head band is on the head of the wearer. In a preferred embodiment, the occipital support is vertically adjustably connected to the head band to permit adjustment of the occipital support across the distance between the head band and the occiput of the wearer. The occipital support can include a lattice configuration for the comfort of the wearer.

In another embodiment of the invention, a head gear apparatus comprises a helmet configured to be supported on the head of a wearer and a face shield mounted to the helmet, the face shield defining a substantially clear viewing area for the wearer. A plurality of substantially transparent film layers can be removably mounted on the face shield over the viewing area. Successive layers can be removed when the layer becomes soiled, such as by splattered fluids during a surgical procedure.

In yet another embodiment of the invention, a head gear apparatus comprises a helmet configured to be supported on the head of a wearer, the helmet including a chin bar extending adjacent the chin of the wearer when the helmet is supported on the head of the wearer. The helmet defines a face opening above the chin bar. A face shield is included that is configured to cover at least a portion of the face opening. A plurality of magnetic elements are disposed between the face shield and the chin bar to attach the face shield on the chin bar. Preferably, the chin bar is continuous from one side of the helmet to the other side of the helmet.

In a preferred embodiment, the plurality of magnetic elements includes at least a pair of magnetic elements supported on the chin bar, with at least one each mounted on opposite sides of the wearer's head. A corresponding number of magnetic elements can be attached to the face shield and arranged to engage the corresponding magnetic elements on the chin bar. Most preferably, the magnetic elements on the chin bar are permanent magnets, while the elements on the face shield are metal slugs.

In another embodiment of the invention, a head gear apparatus comprises a helmet configured to be supported on the head of a wearer, the helmet including a chin bar extending adjacent the chin of the wearer when the helmet is supported on the head of the wearer. The helmet defines a face opening above the chin bar. In accordance with one feature of this embodiment, the chin bar defines a slot. A face shield is provided that is configured to cover at least a portion of the face opening. The face shield has a lower edge and a tab extending from the lower edge. The tab is configured for engagement within the slot to hold the face shield in position on the helmet.

In a preferred embodiment, the chin bar is continuous from one side of the helmet to the other side of the helmet and the slot is defined substantially at the center of the chin bar. The chin bar can define a forward-projecting lower ledge with the slot defined within the ledge. The ledge is configured to support at least a portion of the lower edge of the face shield when the tab extends through the slot.

In another aspect of the invention, the face shield includes an upper edge opposite the lower edge, and the helmet includes an upper ledge at an upper portion of the face opening. The upper ledge is configured to receive at least a portion of the upper edge when the tab extends through the slot in the chin bar.

A surgical garment system is provided that comprises a helmet and a disposable garment. The helmet is configured to be supported on the head of a wearer, with a number of airflow passageways defined by the helmet to direct airflow across the body of the wearer. A fan assembly includes an inlet opening defined by the helmet and a fan supported by the helmet within the inlet opening to direct airflow through the number of airflow passageways. A face shield is supported on the helmet and is attached to a shroud. The shroud is sized and configured to cover at least the helmet.

In one aspect of this embodiment, the shroud includes a filter element positioned on the shroud that is sized to overlay the inlet opening and a portion of the helmet surrounding the inlet opening when the shroud is covering the helmet. The filter element defines an area greater than the area of the inlet opening when the filter element overlies the inlet opening and the helmet. This relative sizing of the filter element to the inlet opening allows for greater manufacturing tolerances with respect to the position of the shroud on the helmet.

DESCRIPTION OF THE PREFERRED EMBODIMENTS

Figure 1:
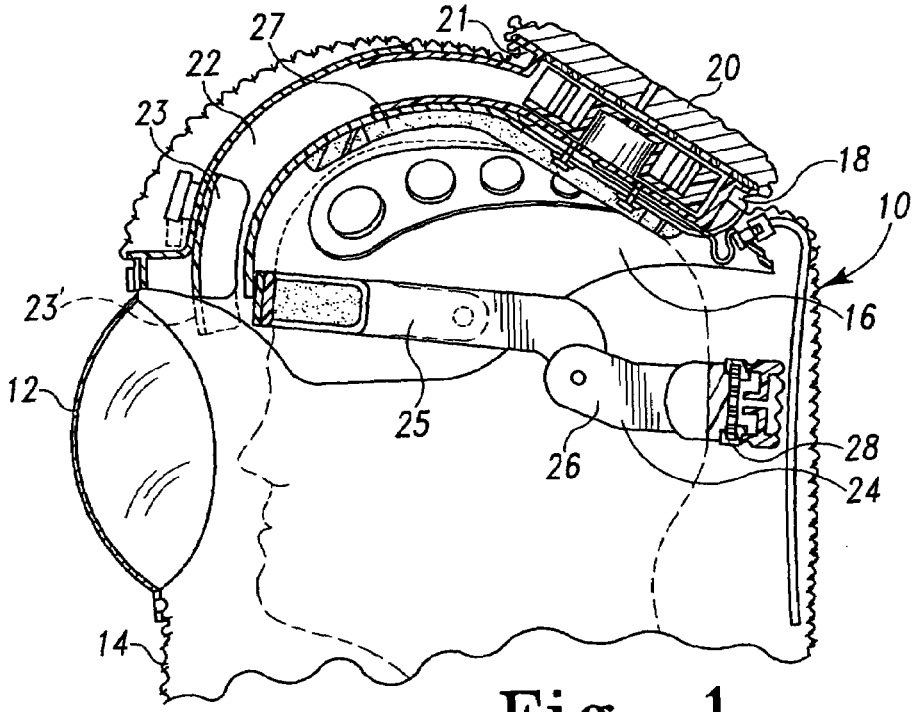
Fig. 1 (Prior Art)
FIG. 1 is a side partial cross-section view of a prior art surgical garment of the type shown in U.S. Pat. No. 6,393,617.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

Figure 2:
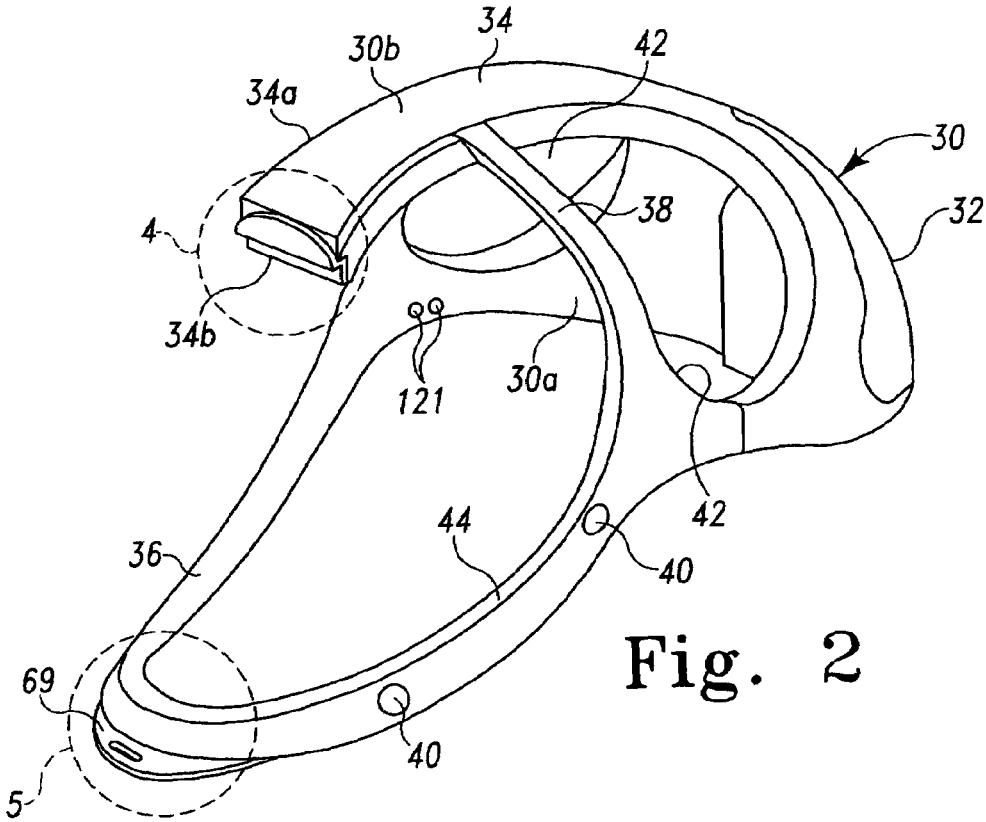
FIG. 2 is a perspective view of a helmet for use with a surgical garment according to one embodiment of the present invention.

Referring now to FIG. 2, a head gear apparatus is illustrated which includes a helmet 30 in accordance with a preferred embodiment of the present invention. The helmet 30 includes a rear portion 32, a forward ventilation duct 34, a chin bar 36 and a pair of support struts 38. Preferably the helmet 30 is formed by an inner shell 30*a* and an outer shell 30*b* that are affixed together once the interior components have been installed. The shells are preferably formed of a high impact but lightweight plastic as is known in the art. The shells 30*a* and 30*b* can be affixed in a conventional manner, such as through sonic welding. Alternatively, the helmet can be a single molded piece, with the interior components added through openings in the molded helmet.

As can be appreciated from FIG. 2, the helmet 30 covers only as little of the wearer's head as necessary to support the functional components of the helmet. Thus, the rear portion 32 and support struts 38 define large side openings 42 where the wearer's head is exposed. Likewise, the support struts and chin bar 36 define a large face opening 44 through which the caregiver looks when wearing the helmet 30. As shown in FIG. 2, a forward portion 34*a* of the ventilation duct 34 projects across a portion of the face opening 44. In use, this portion 34*a* subtends part of the forehead of the wearer so that the free end 34*b* of the duct 34 terminates above the eyes of the wearer. As will be explained herein, this front portion 34*a* does not rest on the forehead but is supported away from the wearer's head. Moreover, the free end 34*b* is supported substantially out of the line of vision and preferably beyond the upper peripheral vision of the wearer. The front portion 34*a* is essentially cantilevered from the rear portion 32 and support struts 38 so that the helmet does not extend around the forehead of the wearer, as in prior art head gear apparatus.

Figure 3:
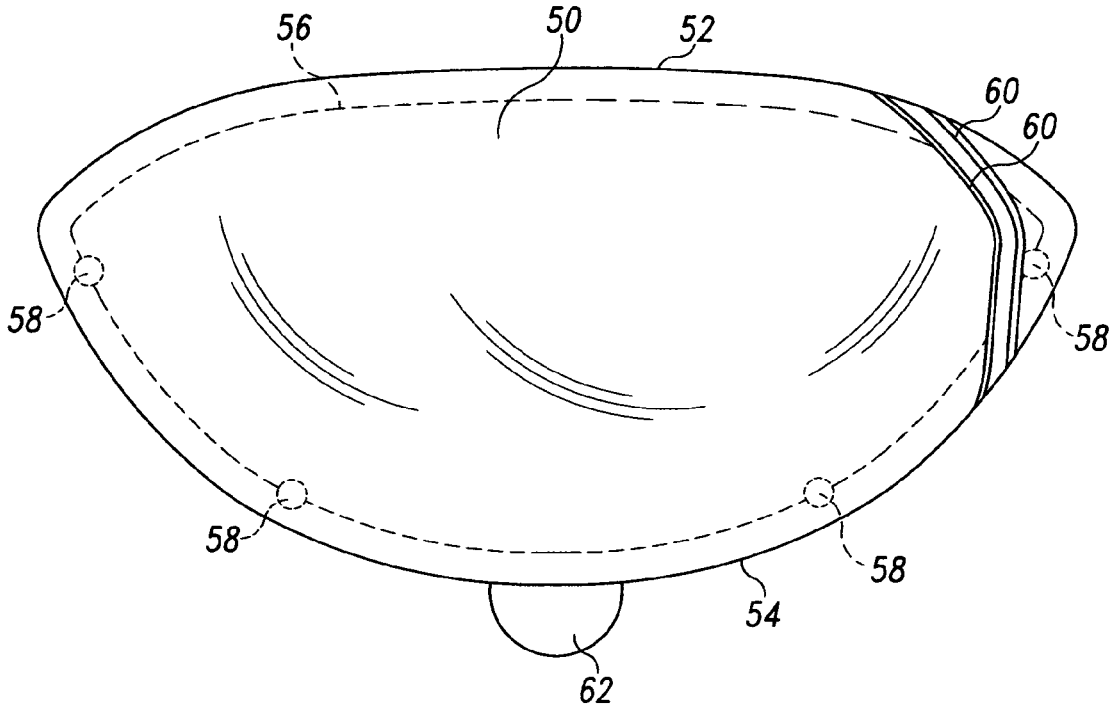
FIG. 3 is a front view of a face shield for use with the helmet shown in FIG. 2.
Figure 6:
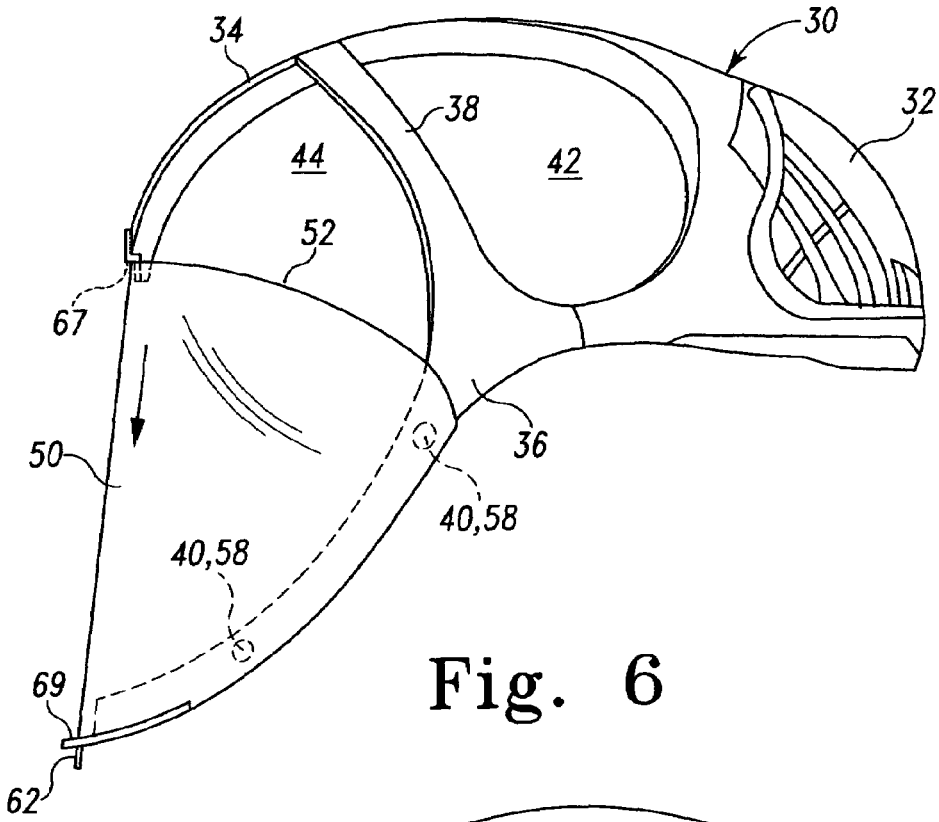
FIG. 6 is a side view of the helmet shown in FIG. 2 with the face shield of FIG. 3 mounted thereon.
Figure 7:
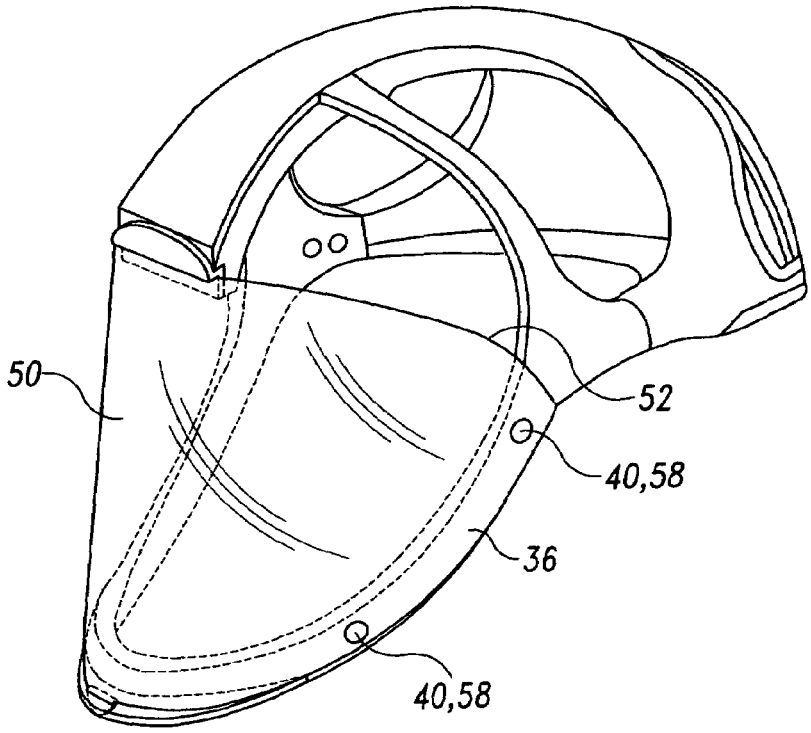
FIG. 7 is a perspective view of the helmet and face shield shown in FIG. 6.
Figure 8:
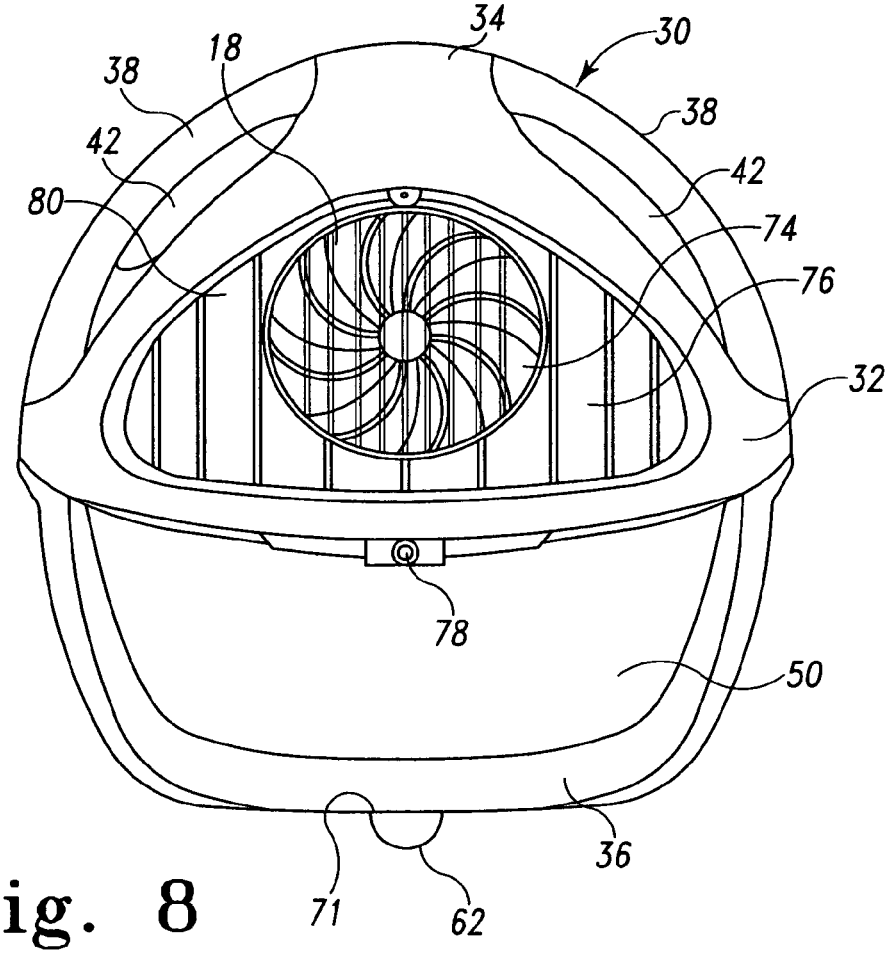
FIG. 8 is a rear view of the helmet and face shield shown in FIGS. 6 and 7.

The present invention contemplates a novel face shield 50 as shown in FIG. 3. This face shield 50 includes an arcuate upper edge 52 and an arcuate lower edge 54. The lower edge 54 is configured to correspond to the contour of the chin bar 36 when the face shield 50 is mounted to the helmet 30 (as shown in FIG. 6). The upper edge extends as far as necessary to define the uppermost viewing area for the caregiver. Thus, as shown in FIGS. 6 and 7, the upper edge 52 leaves a significant portion of the face opening 44 free between the face shield 50 and the support struts 38.

The face shield 50 is formed of a lightweight clear plastic as is known in the art (although the plastic may be tinted or coated for glare reduction). The face shield material is preferably scratch resistant, but since the surgical garment is intended for disposal after a single use the material need not be extremely durable. In one aspect of the invention, a series of peel-away transparent film layers 60 can be removably carried by the face shield 50. The peel-away film layers 60 are formed of a transparent, thin and flexible film material, such as PET-G plastic. Preferably, the layers 60 cover all or a substantial area of the face shield. Each layer 60 can be readily removed during a surgical procedure when the layer becomes scratched or splattered. With prior face shields, a scrub nurse is frequently required to try to wipe the face shield clean of splattered fluids that obstruct the surgeon's vision. With the peel-away layers 60 of the present invention, the vision obscuring material can be removed with the layer. The layers 60 can be provided with indexed tabs (not shown) that extend away from the face shield 50 to make grasping and removing a layer easier, especially when wearing surgical gloves.

In another aspect of the invention, reliable attachment of the face shield 50 to the helmet 30 is simplified. In one feature, the chin bar 36 includes a plurality of magnetic elements 40 mounted to the chin bar. As shown in FIG. 2, two such magnetic elements are provided on each side of the chin bar. The face shield 50 includes comparably positioned magnetic elements 58 mounted around the perimeter of the lower edge 54. Preferably, the elements 40 mounted in the chin bar 36 are magnets, while the elements 58 on the face shield are formed of a magnetically attracted material, such as iron or steel slugs. The elements 40 can be embedded within the chin bar so that the surface of the magnet is generally contiguous with the surface of the chin bar. The magnetic elements 58 on the face shield can be thin metal slugs.

The magnetic attraction between the elements 40 and 58 is sufficiently strong to hold the face shield 50 tightly against the chin bar. On the other hand, the magnetic attraction is sufficiently weak to allow easy removal of the face shield from the helmet. In the preferred embodiment, the face shield 50 is initially generally planar, or only slightly curved. When the face shield is engaged to the helmet, the shield is formed into a broad curve around the face opening 44 of the helmet. This broad curve adds strength to the face shield, but more importantly ensures an undistorted panoramic view from inside the helmet. The magnetic attraction between the elements 40 and 58 must be sufficiently strong to hold the face shield 50 at this curvature against the natural tendency of the shield to spring back to its generally planar configuration. Alternatively, the face shield can be formed with a pre-determined curvature, in which case a lesser degree of magnetic attraction may be sufficient to hold the face shield to the helmet.

Figure 4:
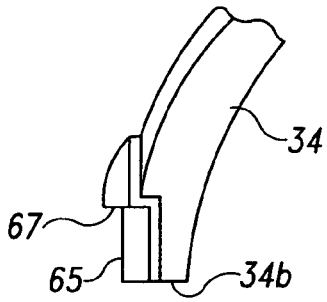
FIG. 4 is an enlarged view of the area 4 identified on the helmet in FIG. 2.

In the preferred embodiment, the magnetic elements 40, 58 form one part of the mechanism for supporting and retaining the face shield 50 on the helmet 30. In another aspect of the invention, the face shield 50 is provided with a tab 62 projecting below the lower edge 54 of the shield. This tab 62 and the upper edge 52 of the shield cooperate with features on the helmet shown in FIGS. 4 and 5. In FIG. 4, a detailed view of the free end 34*b* of the ventilation duct 34 shows that the duct includes a notch plate 65 mounted thereto. The notch plate 65 is curved to conform to the expected curvature of the face shield 50 when it is mounted to the helmet. The notch plate defines an upper ledge 67 as shown in FIG. 6. It is understood that the upper ledge 67 can be integrally formed into the free end 34*b*, rather than incorporated into a separated mounted notch plate 65.

In the preferred embodiment, the upper edge 52 of the face shield rests adjacent to the notch plate 65 while being spaced apart from the upper ledge 67 as shown in FIG. 6. In alternative embodiments, the notch plate 65 can be provided with features to nominally retain the upper edge. For instance, the notch plate 65 can include a dimple at the top of the upper ledge 67 that can form a friction fit with the upper edge 52 of the face shield.

Figure 5:
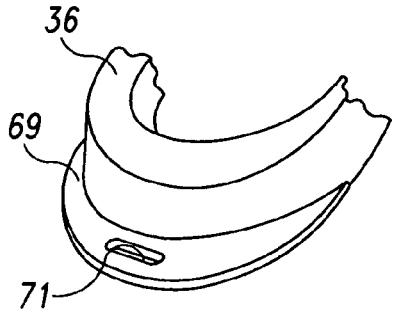
FIG. 5 is an enlarged view of the area 5 identified on the helmet in FIG. 2.

Opposite the notch plate 65, or more particularly at the middle of the chin bar 36, is a lower ledge 69, as shown in FIG. 5. This lower ledge 69 projects slightly forward from the chin bar so that the lower edge 54 of the face shield can rest on the ledge. The ledge defines a tab slot 71 through which the tab 62 on the face shield extends when the shield is mounted on the helmet.

The magnetic elements 40, 58, notch plate 65 and tab/slot 62, 71 features combine to provide a solid attachment of the face shield 50 to the helmet. In addition, these components allow for easy donning of the shroud and face shield (it being understood that the face shield is fastened to a shroud as described herein). Specifically, the face shield is mounted on the helmet by first positioning the tab 62 within the slot 71. When the tab/slot engages, the face shield can be tilted back toward the helmet until the upper edge 52 of the shield rests against the upper ledge 67. At this point, the sides of the face shield can be pushed inward until the magnetic elements 40, 58 engage. The face shield 50 can be removed by reversing these steps, or by simply moving the upper edge 52 of the shield away from the upper ledge 67 and tilting the face shield forward to disconnect the magnetic elements.

The magnetic engagement of the face shield to the helmet provides a secure connection. If one side of the face shield becomes dislodged from the chin bar, the magnetic elements can be quickly re-engaged by a simple turn of the wearer's head. Once the magnetic elements of the face shield move into close proximity to the magnetic elements on the chin bar, the magnetic attraction draws the elements together, thereby re-establishing the connection between the face shield and the helmet.

Optimally, the mounting on or removal of the face shield 50 relative to the helmet can be accomplished with one hand by the wearer, rather than with both hands or with outside assistance. Moreover, the magnetic elements 40, 58 provide a self-aligning feature for the face shield 50 so that the face shield remains centered in its proper position over the face opening 44.

Figure 9:
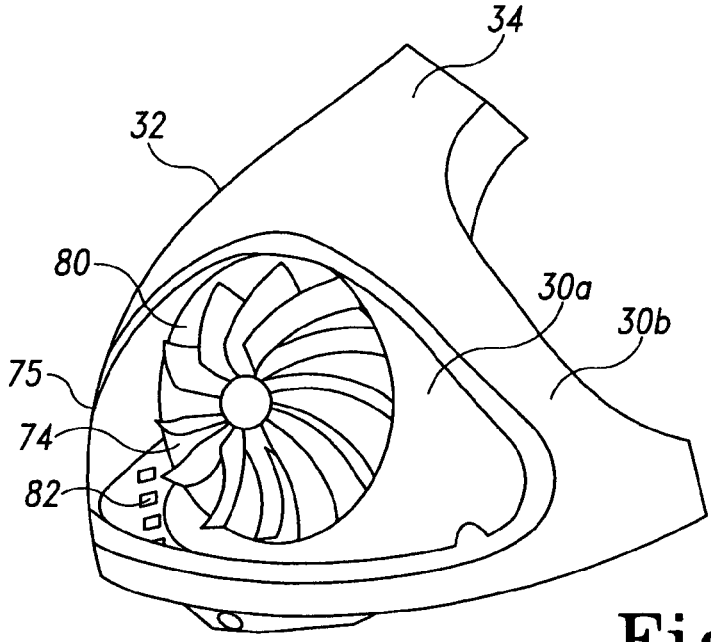
FIG. 9 is a perspective partial view of the helmet shown in FIG. 8, particularly showing the fan assembly with the inlet grill removed.

Referring now to FIGS. 8–12, certain aspects of the air-moving system for the present invention can be discerned. The fan assembly 18 is mounted to the back of the helmet 30 at the rear portion 32. The assembly 18 includes a fan 74 mounted within the shells of the helmet. Preferably, the fan 74 is supported on the inner shell 30*a*, while a fan opening 75 is provided in the outer shell 30*b*, as seen in FIG. 9. The fan opening serves as an air inlet. A grill 76 extends across the opening 75 to prevent the shroud material from being drawn into the fan and to protect the wearer's fingers from encroachment into the fan. As can be appreciated from the rear view of FIG. 8, the fan opening extends across substantially the entire rear portion 32 of the helmet 30.

The base of the rear portion 32 includes a power jack 78 that is electrically connected to the fan 74. The jack 78 receives a power cable that is connected to a power supply and control system (not shown). This power supply and control system can be of the type known in the art. By way of example, this system can include a battery and speed control circuitry that permits control of the speed of the fan, and therefore the airflow rate through the helmet. This power supply and control system is preferably supported around the waist of the wearer so that the weight and bulk of the system does not present a burden on the wearer. In a preferred embodiment, the battery is a lithium ion type battery. This type of battery is lighter weight, has higher energy density, and improved cycle life in comparison to other battery types traditionally used with surgical helmets.

Figure 10:
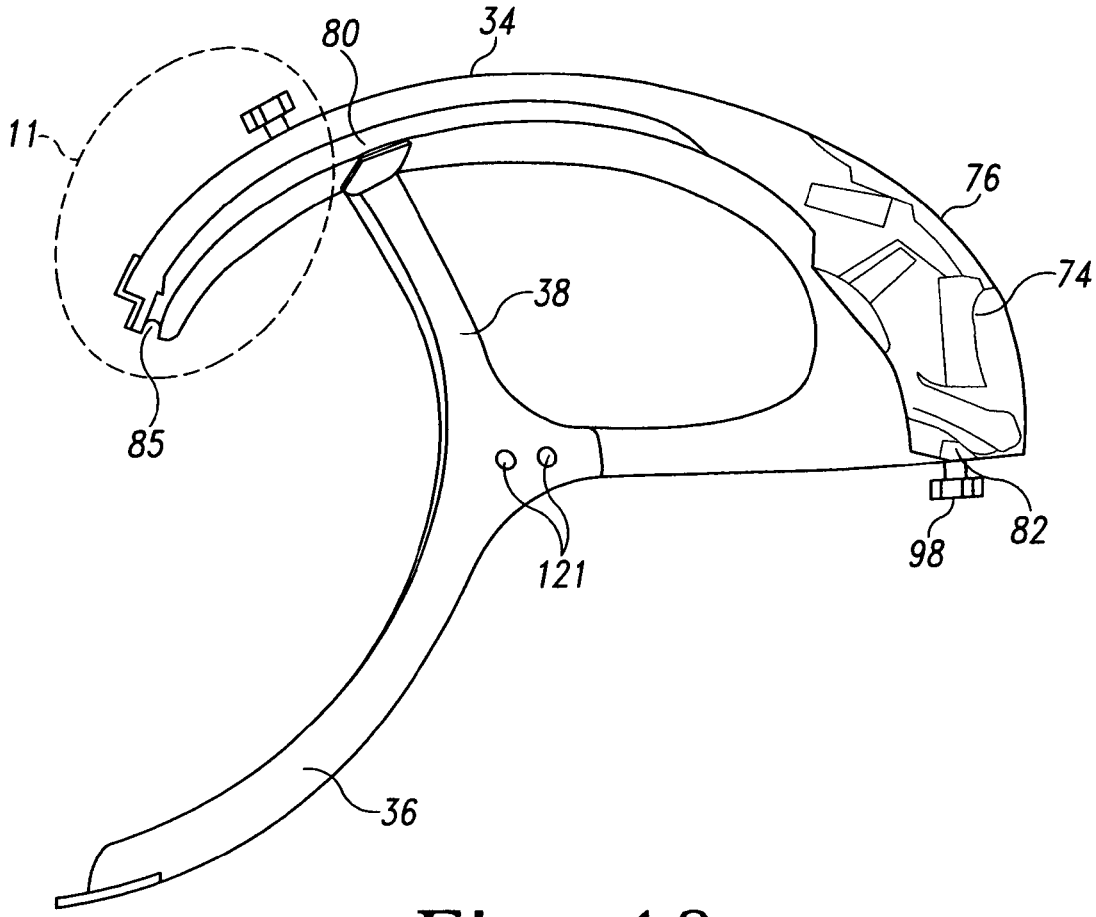
FIG. 10 is a side partial cross-section view of the helmet of FIG. 2, particularly showing the ventilation features of the helmet.
Figure 11:
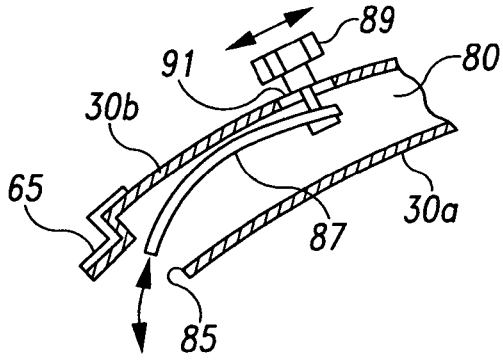
FIG. 11 is an enlarged cross-sectional view of the area 11 identified on the helmet in FIG. 10.

In accordance with one feature of the present invention, the fan assembly 18 provides air flow to both the forward and rear portions of the helmet. In one embodiment of the invention, the fan 74 directs air through a forward ventilation channel 80 and through rear ventilation portals 82. The forward channel 80 is formed within the ventilation duct 34 that extends from the rear portion 32 over the top of the wearer's head toward the forehead, as shown in FIG. 10. The forward channel 80 occupies most of the interior of the duct 34. Preferably, the duct 34, and therefore the channel 80, flares out adjacent the fan 74, as represented by the dashed lines 11 shown in FIG. 10, to maximize the air flow into the channel 80.

The forward air flow passes through the channel 80 in the duct 34 and exits at the forward discharge opening 85. The direction of this discharged airflow can be modified using the mechanism depicted in the detail view of FIG. 11. In particular, a deflector plate 87 is slidably disposed within the channel 80 adjacent the discharge opening. The plate 87 is connected to an adjustment knob 89 which extends through an adjustment slot 91 formed in the outer shell 30*b*. The knob can be loosened to allow the deflector plate 87 to be moved in and out of the discharge opening 85, as depicted by the bi-directional arrows. The deflector plate 87 is preferably curved so that when the plate is fully extended beyond the discharge opening 85 the plate can direct the air flow toward the face of the wearer.

Figure 12:
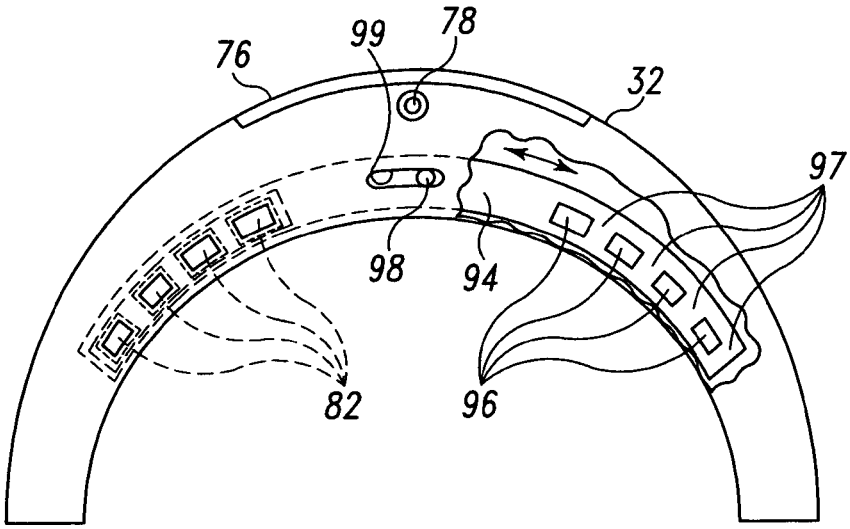
FIG. 12 is a bottom elevational view of the rear portion of the helmet shown in FIG. 10, particularly showing the rear ventilation feature of one embodiment of the present invention.
Figure 18:
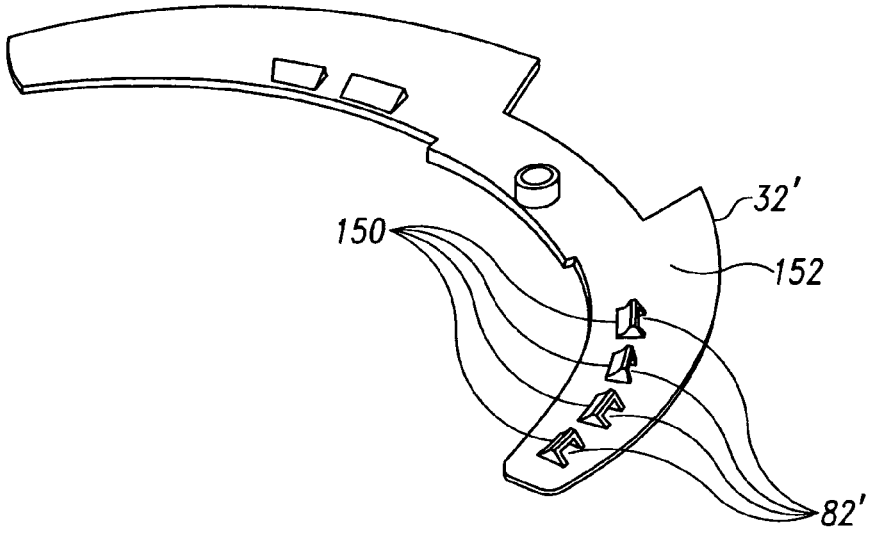
FIG. 18 is a perspective view of a portion of a helmet showing a modified rear ventilation arrangement in accordance with an alternative embodiment of the invention.

As indicated above, the present invention contemplates ventilation at the rear of the helmet as well. The rear ventilation portals 82 are formed in the bottom of the rear portion 32, as best seen in FIG. 12. In the illustrated embodiment, a plurality of portals 82 are defined on both sides of the helmet. In one specific embodiment, the portals 82 can constitute a single portal traversing the circumferential expanse of the multiple portals shown in FIG. 12. The portals 82 are configured to direct air onto the back of the wearer. In a preferred embodiment, shown in FIG. 18, a modified rear portion 32' defines modified portals 82'. In particular, each portal includes a baffle 150 that is arranged to specifically direct the airflow onto the neck of the wearer. Thus, the air flow passes along the inner surface 152 and against the baffles 150 which imparts a directional vector to the airflow through the apertures 82'. It is understood that the baffles 150 can be provided on every portal 82' or on only some of the portals.

In one feature of the preferred embodiment, the rear ventilation portals are adjustable from a fully opened to a fully closed configuration. Returning to FIG. 12, in this embodiment, an arcuate louver plate 94 is mounted within the helmet 30 above the rear ventilation portals 82. The louver plate 94 defines a plurality of louver openings 96 that correspond in size and number to the ventilation portals 82. The louver openings 96 are separated and flanked by walls 97 that are sized to substantially completely cover, or even overlap, the corresponding portals 82.

The louver plate 94 is slidably mounted within the helmet so that the plate can be moved from a fully open position in which the louver openings 96 are aligned with the portals 82 to fully closed position in which the walls 97 are aligned with the portals. An adjustment knob 98 (FIGS. 10, 12) is attached to the louver plate 94. The knob is slidable within a slot 99 to control the side-to-side movement of the louver plate 94. It should be understood that the louver plate 94 can be locked in any position, including a position in which the walls 97 only partially obstruct the rear ventilation portals 82, thereby providing the wearer with a wide range of control over the airflow across the back of the wearer.

From the above discussion, it should be appreciated that the more the rear ventilation portals 82 are blocked or occluded by the walls 97 of the louver plate 94 (and thus the lower the velocity of air flow out of the portals 82), the higher the velocity of air flow out of the forward discharge opening 85. Likewise, the less the rear ventilation portals 82 are blocked or occluded by the walls 97 of the louver plate 94 (and thus the higher the velocity of air flow out of the portals 82), the lower the velocity of air flow out of the forward discharge opening 85.

As thus far described, the helmet provides a support structure for the ventilation components and for the hood and/or shroud donned over the helmet. Another feature of the invention resides in a strap assembly 100, shown in FIGS. 13–16, that supports the helmet off of the head of the wearer. In some prior art systems, at least a portion of the helmet is carried directly on the head of the caregiver. When supported in this way, the helmet not only "smothers" the portion of the head, it also prevents access of ventilation air to that portion. The strap assembly 100 of the present invention essentially elevates the helmet off the head to allow access to the cooling airflow.

Figure 14:
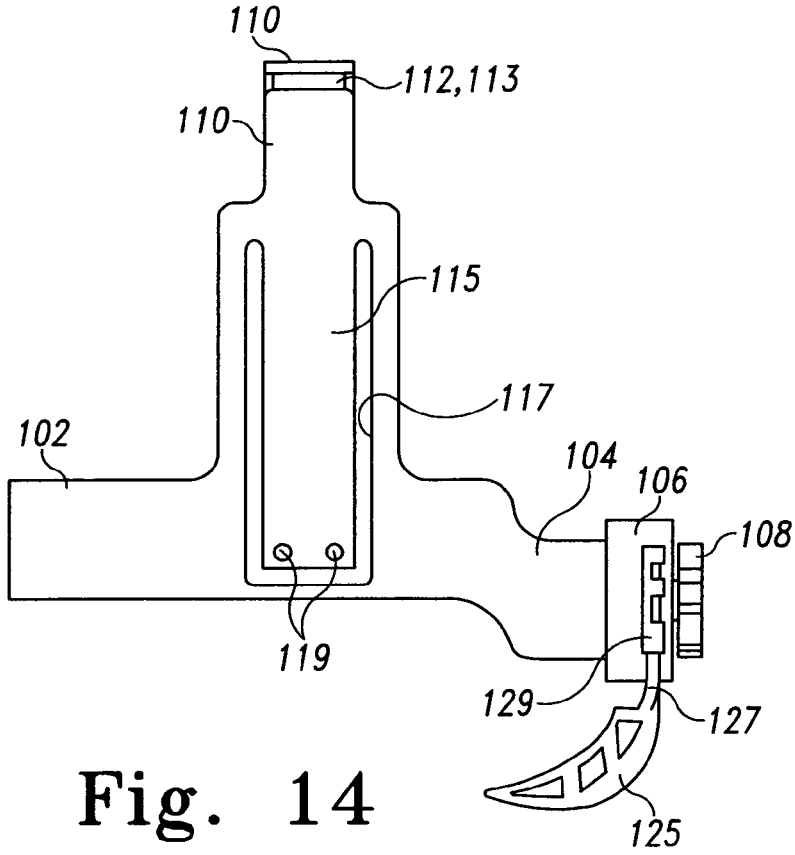
FIG. 14 is a side view of the strap assembly shown in FIG. 13 with an occipital support in accordance with another feature of the present invention.

In one embodiment of the invention, the strap assembly 100 includes a head band portion 102 that is sized to fit around the head of the wearer. A front portion 103 contacts the wearer's forehead. A rear portion of the head band is split into two adjustably connected straps 104 that traverse the back of the wearer's head. As shown in FIG. 14, these adjustable straps 104 are offset downwardly from the front portion 103. A diameter adjustment mechanism 106 interconnects the free ends of the adjustable straps 104 in a manner known in the art. One such adjustment mechanism is shown and described in U.S. Pat. No. 6,393,617, incorporated by reference above. The mechanism includes a rotatable knob 108 that can be used to draw the straps 104 together, thereby decreasing the circumference of the head band 102 about the caregiver's head.

The strap assembly 100 includes opposite crown straps 110 that are arranged to wrap around the crown of the wearer's head. The crown straps can be provided with opposing fastener elements 112, 113 to allow adjustable interconnection of the free ends of the straps 110. In a preferred embodiment, these fastener elements 112, 113 can be mating hook and loop fasteners that can be easily engaged and re-adjusted whenever necessary. The interior of the crown straps 110, as well as the headband 102, can include padding for the wearer's comfort.

Figure 13:
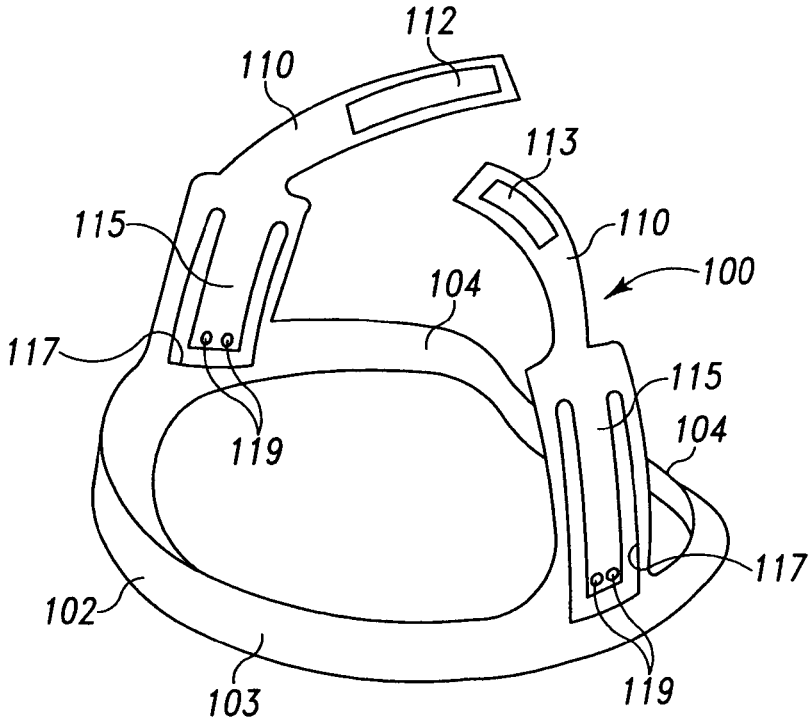
FIG. 13 is a perspective view of a strap assembly for use with the helmet shown in FIG. 2 in accordance with a further embodiment of the present invention.

In addition to providing an additional feature for supporting the strap assembly 100 on the wearer's head, the crown straps 110 also incorporate the mechanism for connecting the strap assembly to the helmet 30. As shown in FIGS. 2 and 10, the helmet 30 includes fastener locations 121 at the junction between the support struts 38 and the chin bar 36. The strap assembly includes attachment tabs 115 that form part of the crown straps 110. The tabs 115 are situated within tab cut-outs 117 defined in the straps 110, as shown in FIG. 13. The upper end of each tab 115 is connected to or integral with the straps 110, while the lower end of the tab is unattached and instead free to flex within the tab cut-outs 117. The lower end of each tab includes a fastening location 119 that corresponds to the fastening locations 121 of the helmet. These fastening locations 119, 121 can be joined by a mechanical fastener, such as a brad, or by spot welding at the respective locations.

Figure 15:
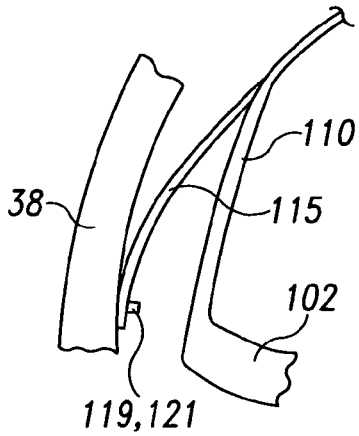
FIG. 15 is an enlarged side view of a connection between the strap assembly of FIG. 13 and the helmet of FIG. 2 in accordance with one aspect of the invention.
Figure 16:
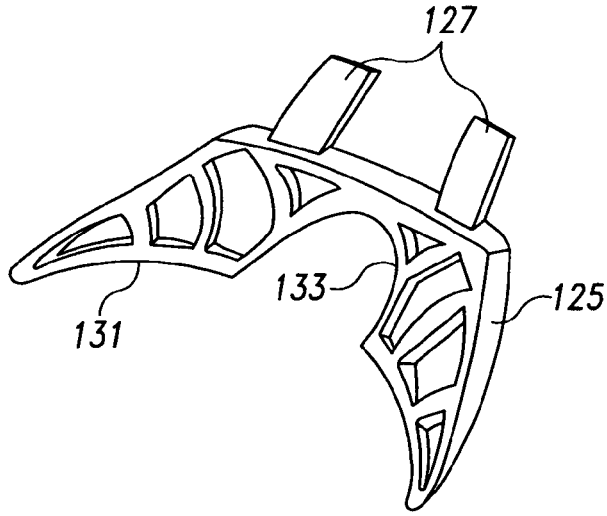
FIG. 16 is a front perspective view of the occipital support depicted in FIG. 14.

It can be appreciated that the strap assembly 100 is connected to the helmet 30 at only two locations—one on each opposite side of the helmet, namely locations 121—as shown in FIG. 15. This connection allows the attachment tabs 115 to operate as a resilient support as the helmet essentially hangs from the strap assembly 100 at these tabs. The circumference of the headband 102 can be freely adjusted without exerting any force upon the interface between the strap assembly and the helmet. When the strap circumference is reduced, the crown straps 110 retract inward from the tabs 115 without compromising the connection at the locations 119, 121. The configuration of the tabs 115 and tab cut-outs 117 also simplify the construction of the strap assembly, since these features can be easily stamped from a flat sheet of material along with the straps 102,104 and 110. Preferably, the fastener locations 121 on the helmet are oriented adjacent the temples of the wearer. In this way, the helmet can be supported in a balanced position as it hangs from the strap assembly 100.

In a further beneficial feature of the present invention, the strap assembly 100 can include an occipital support 125. Alternatively, the occipital support 125 may be attached directly to the helmet 30. The occipital support 125 projects below from the rear of the strap assembly. In a preferred embodiment, the occipital support includes a pair of adjustment bars 127 (FIG. 16) that project upward into mounting brackets 129 formed on the adjustment mechanism 106, as shown in FIG. 14. The bars 127 and brackets 129 can be configured to form an adjustable fit, such as by an adjustable press-fit or an interlocking component arrangement. In this way, the vertical position of the occipital support 125 relative to the strap assembly 100 can be adjusted for the comfort of the wearer.

The occipital support 125 includes opposite support edges 131 that are arranged and configured to contact the occipital ridge at the base of the wearer's skull. The occipital support 125 employs an open lattice so that the support can flex during use. The open lattice also allows airflow through the support 125. A hinge portion 133 can be defined between the support edges 131 to accommodate the occipital notch in the skull and to allow another degree of flex for the occipital support. The occipital support 125 thus operates as an anchor of sorts against the base of the wearer's skull that cooperates with the head band 102 to provide stable support for the helmet. This anchor effect is particularly beneficial in connection with the attachment tabs from which the forward portion of the helmet hangs. The occipital support shares the load of supporting the helmet with the head band and helps distribute that load in a more balanced manner than with prior helmet systems.

Figure 17:
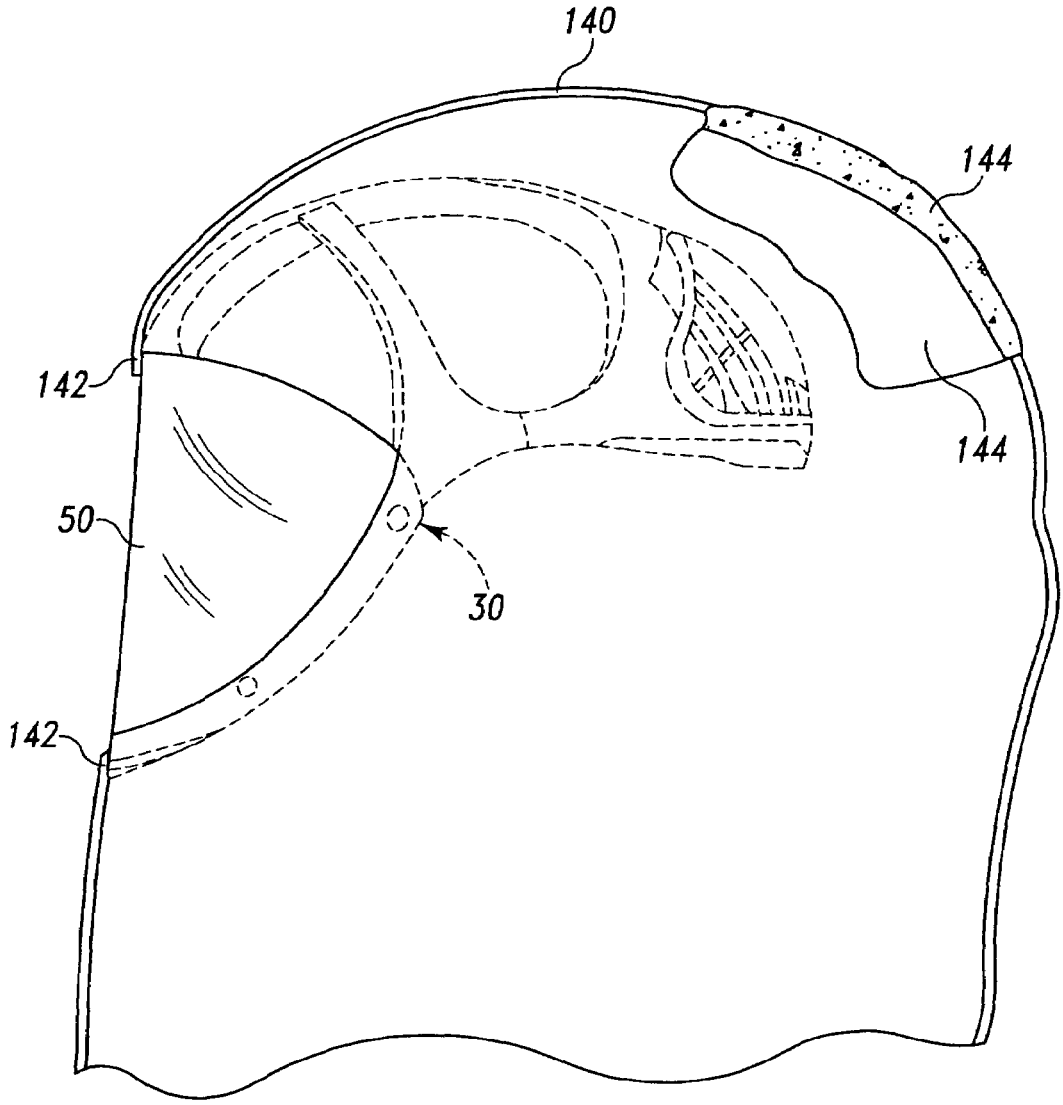
FIG. 17 is a side view of the helmet and face shield shown in FIG. 6 with a fabric shroud mounted thereto.

The face shield 50 is affixed to a fabric shroud, such as the shroud 140 shown in FIG. 17. Preferably, the shield 50 is affixed to the shroud at a sealing perimeter 56 (FIG. 3) adjacent the upper and lower edges 52, 54 of the shield. The sealing engagement 142 can be accomplished in a manner conventional in the art; however, it is understood that a substantially air-tight seal of the face shield to the shroud is important. First, the air-tight seal prevents the incursion or expulsion of airborne contaminants to and from the surgical garment. Second, the air-tight seal maintains the airflow through the forward ventilation duct 34 without leakage through the face shield.

The shroud 140 includes a filter element 144 sealed or sewn to the shroud in a known manner. The filter element can be conventional in material and properties. In a preferred embodiment, the filter element includes an electrostatic media capable of removing at least 91% of aerosolized particulates down to 0.1 microns. In one embodiment of the invention, the filter element 144 is larger in area than the fan opening 75. This larger area requires less tolerance in the position of the filter element relative to the fan assembly 18. When the shroud 140 is mounted over the helmet 30 and the fan 74 is operating, the suction generated by the fan will be sufficient to hold the filter element 144 in position over the fan opening 75. The over-sized nature of the filter element relative to the fan opening ensures that only the filter element is positioned over the fan, and not the shroud material itself.

Figure 19:
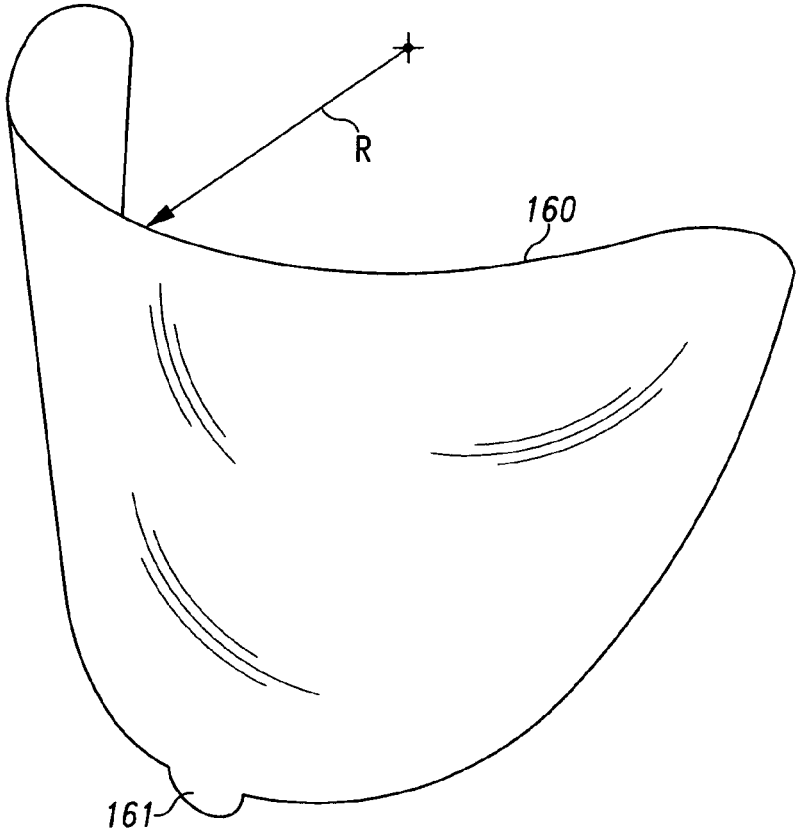
FIG. 19 is a perspective view of a pre-curved face shield in accordance with another embodiment of the invention in which the face shield is produced from roll stock.

As explained above, the face shield is curved when mounted on the helmet to ensure an unobstructed, undistorted view through the face shield. In an alternative embodiment of the invention, a face shield 160 shown in FIG. 19 can be pre-curved—i.e., it is formed with a curvature R. In accordance with this embodiment, this pre-curvature is created by stamping the face shield from a sheet of roll stock. In other words, the plastic sheet material for the face shield 160 can be provided wound on a roll as roll stock. The sheet is unwound from the roll stock for stamping into the shape shown in FIG. 19. However, since the sheet material is rolled, it develops a shape memory curvature. This curvature R gives the face shield 160 its pre-curved configuration that facilitates mounting on the helmet 30. As explained above, the face shield 160 is mounted on the helmet by extending the tab 161 through the slot 71 in the chin bar (see FIG. 8). The pre-curvature of the face shield automatically places the magnetic elements (not shown), such as the elements 58 (see FIG. 3) in close proximity to the magnetic elements 40 on the chin bar (see FIG. 2). In some cases, once the face shield tab is properly positioned, the magnetic elements 40, 58 will automatically engage so that the face shield is quickly and easily mounted on the helmet.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

What is claimed is:

1. A head gear apparatus comprising:

a helmet configured to be supported on the head of a wearer;

at least two airflow passageways defined by said helmet, a first one of said passageways arranged to direct airflow across the back of the wearer and a second one of said passageways arranged to direct airflow across the face of the wearer when said helmet is supported on the head of the wearer; and a fan supported by said helmet to direct airflow through said at least two airflow passageways, wherein at least one of said airflow passagewys includes means for positively continuously varying the airflow through said at least one passageway while leaving the flow of other passageway unimpeded.

2. The head gear apparatus according to claim 1, wherein said first one and said second one of said passageways include means for adjusting the airflow through said corresponding passageway.

3. The head gear apparatus according to claim 1, wherein:

said helmet is configured to support said fan at the back of the wearer's head when the helmet is supported on the wearer's head; and said first airflow passageway includes a conduit defined by said helmet extending from said fan to the forehead of the wearer.

4. The head gear apparatus according to claim 3, wherein said second airflow passageway includes a plurality of portals defined in said helmet adjacent said fan, said portals arranged to direct airflow across the back of the wearer.

5. The head gear apparatus according to claim 4, wherein at least a number of said plurality of portals includes a baffle configured to direct air flow through the portal in a predetermined direction.

6. The head gear apparatus according to claim 4, wherein said second airflow passageway includes means for adjusting the airflow through said at least one passageway; and wherein said means for adjusting the airflow includes a louver plate disposed within said helmet between said plurality of portals and said fan, said louver plate defining a plurality of louver openings corresponding to said plurality of portals, said louver plate slidable within said helmet to adjustably overlap at least a portion of said portals.

7. The head gear apparatus according to claim 4, wherein said first airflow passageway includes second means for adjusting airflow through said first passageway.

* * * * *